US006018276A

United States Patent [19]

Hirota et al.

[11] Patent Number: 6,018,276

[45] Date of Patent: Jan. 25, 2000

[54] WAVEGUIDE INPUT APPARATUS OF TWO ORTHOGONALLY POLARIZED WAVES INCLUDING TWO PROBES ATTACHED TO A COMMON BOARD

[75] Inventors: Makoto Hirota, Hyogo; Atsushi Nagano, Osaka, both of Japan

[73] Assignee: Sharp Kabushiki Kaisha, Osaka, Japan

[21] Appl. No.: 09/004,284

[22] Filed: Jan. 8, 1998

[30] Foreign Application Priority Data

Jan. 14, 1997 [JP] Japan ..... 9-004811
Aug. 27, 1997 [JP] Japan ..... 9-231127

[51] Int. Cl.[7] ..... H01P 1/61

[52] U.S. Cl. ..... 333/26; 333/135; 343/756

[58] Field of Search ..... 333/26, 135, 21 A, 333/137; 343/756

[56] References Cited

U.S. PATENT DOCUMENTS

| | | | |
|---|---|---|---|
| 3,622,884 | 11/1971 | Kent | 257/438 |
| 5,216,432 | 6/1993 | West | 343/786 |
| 5,245,353 | 9/1993 | Gould | 333/21 A X |
| 5,374,938 | 12/1994 | Hatazawa et al. | 333/21 A X |
| 5,422,611 | 6/1995 | Kashima et al. | 333/26 X |
| 5,459,441 | 10/1995 | Weber et al. | 333/136 |

FOREIGN PATENT DOCUMENTS

| | | |
|---|---|---|
| 0 552 944 A1 | 7/1993 | European Pat. Off. . |
| 42 13 539 A1 | 10/1992 | Germany . |
| 58 213503 | 3/1984 | Japan . |
| 61 052001 | 3/1986 | Japan . |
| 01 062901 | 3/1989 | Japan . |
| 4-329701 | 11/1992 | Japan . |
| 07 263903 | 10/1995 | Japan . |
| 07 321502 | 12/1995 | Japan . |
| 9-36605 | 2/1997 | Japan . |
| 9-36618 | 2/1997 | Japan . |
| 2 256 534 | 12/1992 | United Kingdom . |

OTHER PUBLICATIONS

"Integrated input Circuit for Satellite Converter," J. Modelski et al., Proceedings of the 19th European Microwave Conference, London, Sep. 4–7, 1989, pp. 543–548.

*Primary Examiner*—Justin P. Bettendorf

[57] ABSTRACT

A waveguide input apparatus of two orthogonally polarized waves includes a waveguide having two cavities passing through the outer wall thereof to the interior, a first probe provided protruding from an inner wall of the waveguide via a first cavity so that the leading end is parallel to a first plane of polarization, a second probe provided protruding from the inner wall of the waveguide via a second cavity so that the leading end is parallel to a second plane of polarization, and a circuit board provided at the outer wall of the waveguide so as to be parallel to the second plane of polarization, and having the first probe and the second probe connected thereto. A converter for satellite broadcasting receiver employing this apparatus is also provided.

36 Claims, 14 Drawing Sheets

WAVEGUIDE INPUT APPARATUS OF TWO ORTHOGONALLY POLARIZED WAVES INCLUDING TWO PROBES ATTACHED TO A COMMON BOARD

BACKGROUND OF THE INVENTION

1. Field of the Invention

The present invention relates to a waveguide input apparatus of two orthogonally polarized waves. More particularly, the present invention relates to improvement of a waveguide input apparatus of two orthogonally polarized waves characterized in the structure of the waveguide input unit in a converter for satellite broadcasting and communication receiver to receive two electromagnetic waves, each having a plane of polarization orthogonal to each other, and a converter for satellite broadcasting and communication receiver (termed "for satellite broadcasting receiver" hereinafter) using such a waveguide of two orthogonally polarized waves.

2. Description of the Background Art

An example of a conventional waveguide input apparatus of two orthogonally polarized waves will be described hereinafter with reference to FIGS. 16A–16C. FIG. 16A is a cross sectional view taken along cross section S—S of FIG. 16C.

A waveguide input apparatus 90 for two orthogonally polarized waves includes a waveguide 90*a* for introducing a polarized wave, a probe 25 for receiving a vertically polarized wave, attached to waveguide 90*a* in a direction parallel to a plane of polarization 2 of a vertically polarized wave, a probe 26 attached to waveguide 90*a* in a direction parallel to a plane of polarization 3 of a horizontally polarized wave, a short bar 6, a circuit board 27 connected to probe 25 and arranged at a mount 29*a* in a manner orthogonal to probe 25, a circuit board 28 connected to probe 26 and arranged at a mount 29*b* in a manner orthogonal to probe 26, and a connecting portion 31 for connecting circuit board 27 and circuit board 28.

Waveguide 90*a* forms a short wall 8 at the inner wall. Two probes 25 and 26 are attached to waveguide 90*a* in a direction parallel to the two planes of polarization 2 and 3, respectively. The connection between probes 25 and 26 and circuit boards 27 and 28 is effected arranging respective components in an orthogonal manner (in skew lines). At the outer wall of waveguide 90*a*, mounts 29*a* and 29*b* from which probes 25 and 26 protrude, respectively, are provided. Circuit boards 27 and 28 are attached to mounts 29*a* and 29*b*, respectively. Plane of polarization 2 and plane of polarization 3 received by waveguide 90*a* are orthogonal to each other. The vertically polarized wave corresponds to plane of polarization 2, and the horizontally polarized wave corresponds to plane of polarization 3. Probe 25 and short bar 6 are provided to feed vertically polarized waves and transmit a polarized signal to the circuit board. Probe 26 and short wall 8 are provided to feed horizontally polarized waves and transmit a polarized signal to the circuit board.

Probes 25 and 26 receive two orthogonally polarized waves respectively. Probe 25 transmits the received polarized signal of plane of polarization 3 to circuit board 27. Probe 26 transmits the received polarized signal of plane of polarization 2 to circuit board 28. Circuit board 28 provides a polarized signal to circuit board 27 via connection portion 31. Circuit board 27 combines the polarized signal from probe 25 and the polarized signal from circuit board 28.

Another example of a waveguide input apparatus of two orthogonally polarized waves will be described with reference to FIGS. 17A–17C. FIG. 17A is a sectional view taken along a cross section T—T of FIG. 17C.

A waveguide input apparatus 100 of two orthogonally polarized waves includes a waveguide 110*a*, probes 34 and 35 attached in a direction parallel to the two planes of polarization 2 and 3 orthogonal to each other, respectively, and a circuit board 32 connected to probes 34 and 35, and arranged at a mount 33 at an angle of approximately 45° to probes 34 and 35, respectively.

Mount 33 of circuit board 32 formed at the outer wall of waveguide 100*a* has circuit board 32 attached so as to be 45° with respect to the two planes of polarization 2 and 3. Therefore, the two signals from two probes 34 and 35 are received by one circuit board 32. More specifically, probes 34 and 35 receive two orthogonally polarized waves respectively. Probe 34 transmits the received polarized signal of plane of polarization 2 to circuit board 32. Probe 35 transmits the received polarized signal of plane of polarization 3 to circuit board 32. Circuit board 32 combines these polarized signals.

In order to amplify and combine the signals received at probes 25 and 26 for output in the waveguide input apparatus having an input structure described with reference FIGS. 16A–16C, a circuit for supplying the signals from probes 25 and 26 to respective one of circuit boards 27 and 28 must be provided. Moreover, a signal combine means at one circuit board 27 is needed and a signal from the other circuit board 28 must be transmitted to circuit board 27 with the combine means via a connection portion 31.

The above-described transmission of a signal will increase the complexity of the circuit patterns and structures. Furthermore, there is a possibility of increasing signal loss and inducing interference since a polarized signal has an extremely high frequency. The circuit design may be extremely difficult since critical factors must be taken into account for the arrangement of the circuit pattern. In the assembly of a waveguide, two circuit boards 27 and 28 must be attached, and particular care must be exerted from the standpoint of high frequency for connecting the boards to connection portion 3. The task thereof is difficult, resulting in increase of the cost.

The waveguide input apparatus having the input structure described with reference to FIGS. 17A–17C is advantageous in that wiring for connecting two boards is not required since there is only one board. However, this apparatus requires the precise provision of (two) holes for insertion of probes 34 and 35 at 45° about the center plane with respect to mount 33 of circuit board 32. The structure design of the mount will become complicated. Also, a working skill of a high level is indispensable. This means that the working task will become difficult with a more complex assembly task. As a result, the fabrication cost will be increased. Also, variation in the quality of the mass production becomes greater, so that the performance requirement cannot be met unless adjustment is carried out for each apparatus.

A converter for satellite broadcasting receiver is known as an apparatus utilizing such a waveguide apparatus of two orthogonally polarized waves. The converter for satellite broadcasting receiver has the above-described problems of the waveguide apparatus of two orthogonally polarized waves.

SUMMARY OF THE INVENTION

In view of the foregoing, an object of the present invention is to provide a waveguide input apparatus of two orthogonally polarized waves that allows the circuit design to be facilitated, and a converter for satellite broadcasting receiver using such a waveguide input apparatus.

Another object of the present invention is to provide a waveguide input apparatus of two orthogonally polarized waves that allows the circuit design and the structure design of a probe attach portion to be facilitated and a converter for satellite broadcasting receiver using such a waveguide input apparatus.

A further object of the present invention is to provide a waveguide input apparatus of two orthogonally polarized waves that allows the circuit design, the structure design of a probe attach portion, and probe process to be facilitated, and a converter for satellite broadcasting receiver using such a waveguide input apparatus.

Still another object of the present invention is to provide a waveguide input apparatus of two orthogonally polarized waves that allows the circuit design, the structure design of a probe attach portion, probe process, and probe attachment to be facilitated and a converter for satellite broadcasting receiver using such a waveguide input apparatus.

A still further object of the present invention is to provide a waveguide input apparatus of two orthogonally polarized waves with low fabrication cost that allows the circuit design, the structure design of a probe attach unit, probe process, and probe attachment to be facilitated, and a converter for satellite broadcasting receiver using such a waveguide input apparatus.

Yet a further object of the present invention is to provide a waveguide input apparatus of two orthogonally polarized waves with low material cost that allows the circuit design, the structure design of the probe attach portion, probe process, and probe attachment to be facilitated, and a converter for satellite broadcasting receiver using such a waveguide input apparatus.

Yet another object of the present invention is to provide a waveguide input apparatus of two orthogonally polarized waves with low material cost and assembly process cost that allows the circuit design, the structure design of a probe attach portion, probe process, and probe attachment to be facilitated, and a converter for satellite broadcasting receiver using such a waveguide input apparatus.

Yet a still further object of the present invention is to provide a waveguide input apparatus of two orthogonally polarized waves with low fabrication cost and superior in mass production that allows the circuit design, the structure design of a probe attach portion, probe process, and probe attachment to be facilitated, and a converter for satellite broadcasting receiver using such a waveguide input apparatus.

An additional object of the present invention is to provide a waveguide input apparatus of two orthogonally polarized waves with low fabrication cost and superior in mass production and receiver characteristic that allows the circuit design, the structure design of the probe attach portion, probe process and probe attachment to be facilitated, and a converter for satellite broadcasting receiver using such a waveguide input apparatus.

A waveguide input apparatus of two orthogonally polarized waves according to the present invention includes a waveguide having one end open and another end closed by a short wall, and into which a first polarized wave and a second polarized wave are introduced, respective first and second polarized waves having a first plane of polarization and a second plane of polarization, respectively, orthogonal to each other. The waveguide has two cavities passing through the outer wall thereof to the interior. The waveguide input apparatus of two orthogonally polarized waves further includes a first probe provided protruding from the inner wall of the waveguide via the first cavity so that the leading end is parallel to the first plane of polarization, a second probe provided protruding from the inner wall of the waveguide via the second cavity so that the leading end is parallel to the second plane of polarization, and a circuit board provided at the outer wall parallel to the second plane of polarization, and connected to the first and second probes. The same effect can be achieved with a converter for satellite broadcasting receiver using this waveguide input apparatus of two orthogonally polarized waves.

Since the first and second probes are connected to a common circuit board, the entire circuit for combining the outputs of the first and second probes can be formed on the common circuit board. Therefore, designing is facilitated. Furthermore, the material cost is not expensive since only one board is used. The probe can be positioned more accurately within the waveguide since the first and second probes are attached to the waveguide after the first and second probes are both attached accurately to the circuit board. Therefore, favorable receiver characteristic can be obtained.

Preferably, the second probe includes a core conductor. The core conductor includes a first portion from the circuit board, provided protruding at the inner wall of the waveguide, and a leading end portion formed bent from the leading end of the first portion so as to be parallel to the second plane of polarization and substantially at a right angle to the first plane of polarization. Further preferably, the second probe has the first portion formed parallel to the first plane of polarization and the leading end formed in a bent manner to be substantially at a right angle to the first portion and also to the first plane of polarization.

The second probe can further include a dielectric that covers the first portion of the core conductor. The end portion of the dielectric at the leading end side of the second probe can be formed as a portion of the inner wall of the waveguide. The surface of the dielectric can be covered with a metal thin film. The second probe can be attached to the circuit board so that the leading end portion of the second probe is capable of being deviated within a predetermined angular range centered about the direction orthogonal to the center axis of the waveguide in a plane parallel to the second plane of polarization.

According to another aspect of the present invention, a waveguide input apparatus of two orthogonally polarized waves includes a waveguide to which a first polarized wave and a second polarized wave respectively having a first plane of polarization and a second plane of polarization, orthogonal to each other are introduced, and having one end open and another end closed by a short wall. The waveguide has a first cavity passing through a first outer wall to its interior, and a second cavity passing through a second outer wall to the interior. The waveguide input apparatus of two orthogonally polarized waves includes a first probe provided protruding from the inner wall of the waveguide via the first cavity so that the leading end is parallel to the first plane of polarization, a second probe provided protruding from the inner wall of the waveguide through the second cavity so that the leading end is parallel to the second plane of polarization, and a circuit board portion having a first portion to which the first probe is connected, a second portion to which the second probe is connected, and a flexible portion coupling the first and second portions.

The corner of the outer wall of the waveguide in contact with the flexible portion of the circuit board is preferably molded to a substantially rounded form.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1C:
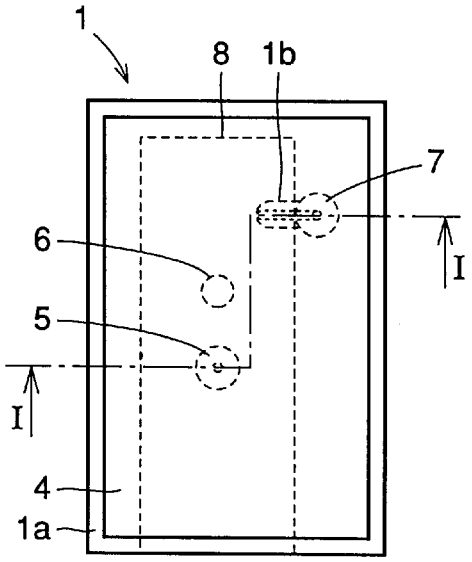
FIGS. 1A, 1B, an 1C are a front sectional view, a side view, and a plan view, respectively, of a waveguide input apparatus of two orthogonally polarized waves according to a first embodiment of the present invention.
Figure 1A:
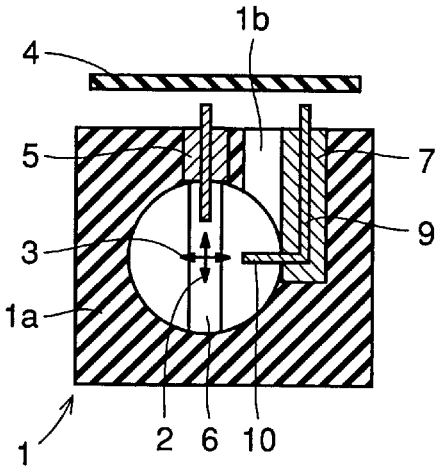
Figure 1B:
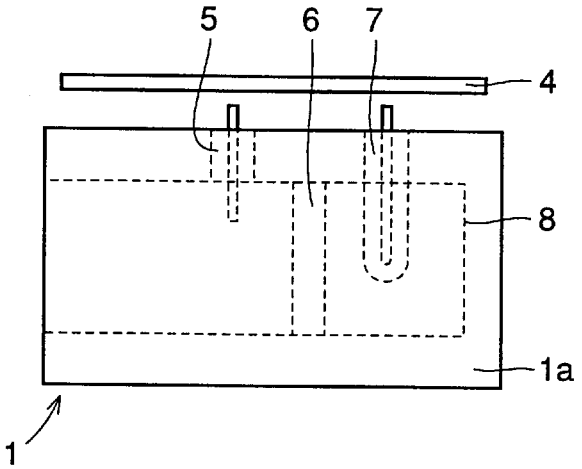

A waveguide input apparatus 1 of two orthogonally polarized waves according to a first embodiment of the present invention will be described hereinafter with reference to FIGS. 1A–1C. In FIGS. 1A–1C and 16A–16C, like elements are denoted by the same reference characters allotted, and their names and functions are identical. Therefore, detailed description thereof will not be repeated here. In addition, directional terms, such as parallel and orthogonal imply and include directions substantially similar to the terms as readily understood by one of ordinary skill in the art.

One plane of polarization 3 (horizontally polarized wave) and a circuit board 4 are located in parallel. The other plane of polarization 2 (vertically polarized wave) and two probes 5 and 7 are located in parallel. Probes 5 and 7 are both connected to circuit board 4. A leading end 10 of a core conductor 9 in probe 7 is bent substantially at right angles protruding in a direction from the inner wall of a waveguide 1*a*. Probe 7 is inserted from the above of waveguide 1*a* into a cavity formed therein. FIGS. 1A–1C show the state where probe 7 is already attached. As shown in FIGS. 1A–1C, a cavity 1*b* is formed in the state where probe 7 is attached. A zinc die cast, an aluminum die cast, and the like is used mainly as the material of waveguide 1*a*. As the material of probes 5 and 7, resins such as polyethylene and fluoropolymer, such as Teflon are mainly used. As the material of core conductor 9, metal such as brass, nickel and the like is mainly used.

According to the first embodiment, the two probes 5 and 7 for receiving two orthogonally polarized waves are connected to the same circuit board 4. The two probes 5 and 7 are attached parallel to each other in a direction orthogonal to the outer wall of waveguide 1*a*.

In contrast to the case where two probes 5 and 7 are connected to separate circuit boards, the circuit design including the arrangement of the circuit pattern of the combining process of two polarized waves which are high frequency signals is simplified. The material cost can be reduced since only one circuit board is required. A waveguide input apparatus of two orthogonally polarized waves with favorable cross polarization characteristic and input return loss can be provided.

In contrast to the case where probes 5 and 7 are attached at an angle of 45° at the outer wall of the waveguide, the object of the structure design of the probe attach portion and process of the probe attachment can be simplified using a hole that can be formed with a mold. Also, the probe attach workability is improved. Thus, a waveguide input apparatus of two orthogonally polarized waves can be provided that allows the assembly process cost to be reduced and superior in mass production.

Figure 2A:
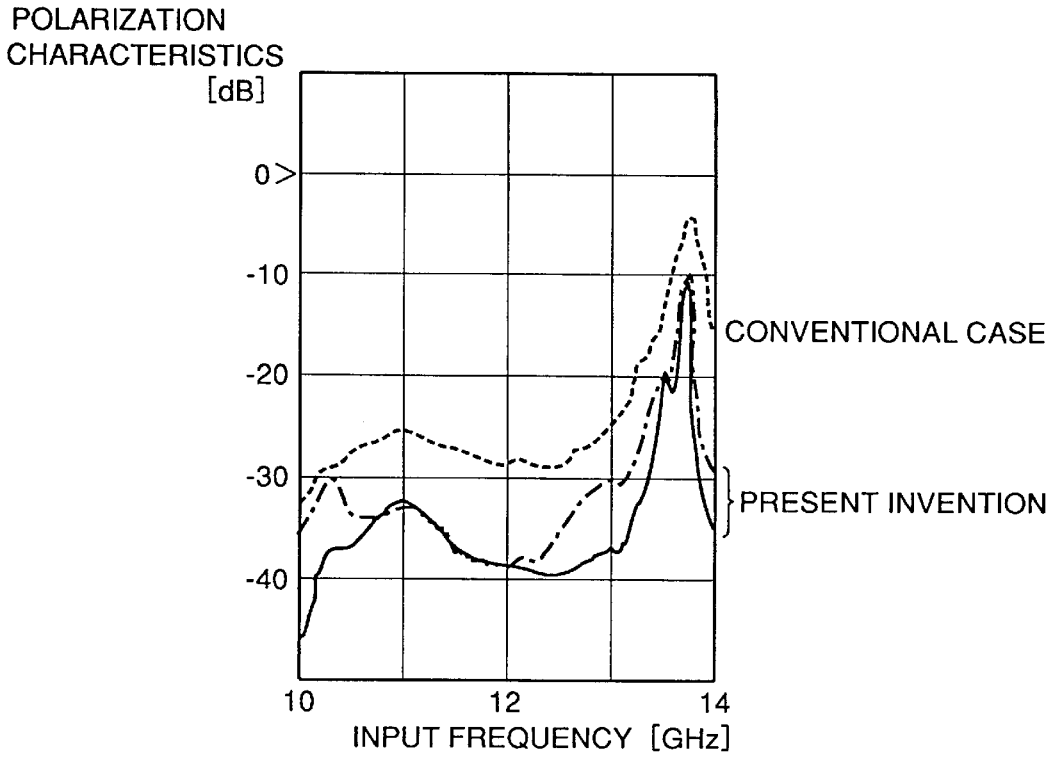
FIGS. 2A shows the relationship between the input frequency and the cross polarization characteristic of the waveguide input apparatus of two orthogonally polarized waves of the first embodiment of the present invention.
Figure 2B:
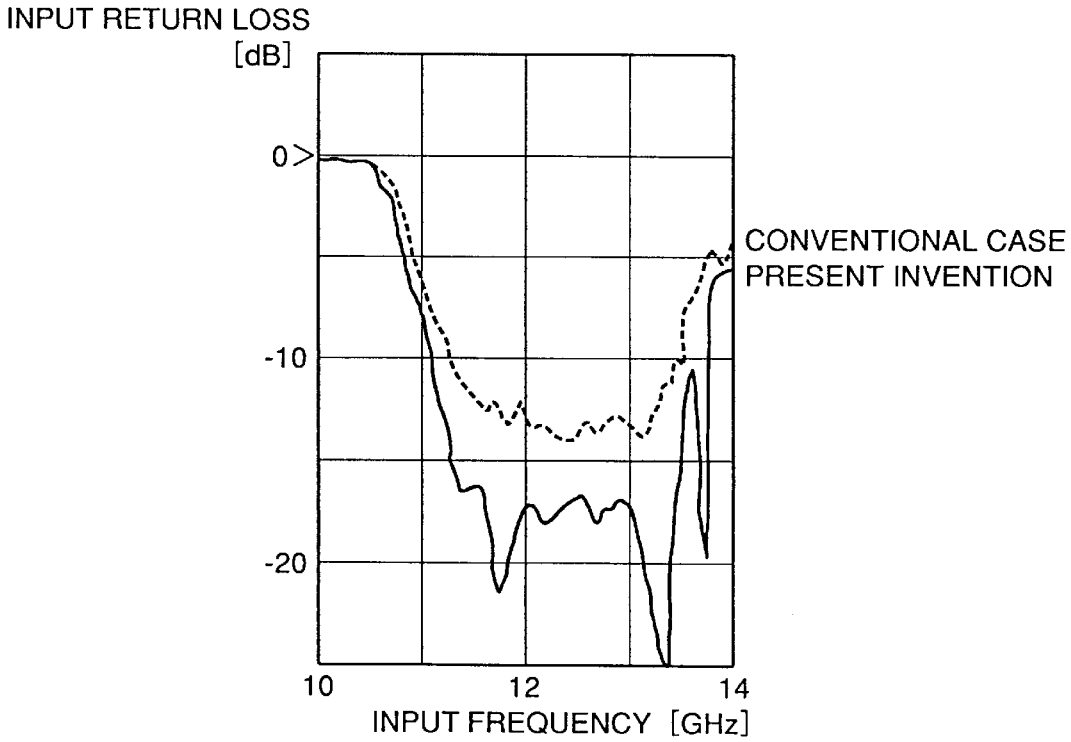
FIG. 2B shows the relationship between the input frequency and the input return loss of the waveguide input apparatus of two orthogonally polarized waves of the first embodiment of the present invention.

The relationship between the input frequency and the cross polarization characteristic, and between the input frequency and the input return loss of the waveguide input apparatus of two orthogonally polarized waves according to the present embodiment will be described with reference to FIGS. 2A and 2B in comparison with a conventional case. In the waveguide input apparatus of two orthogonally polarized waves according to the present embodiment, consideration of a high level for the arrangement of the circuit pattern for preventing increase of signal loss and interference of polarized signals having high frequency is no longer required. Therefore, the circuit pattern designing is simplified. The consideration originated from a board manipulating a high frequency signal is also not required in the assembly process for mounting the circuit board. It is appreciated from FIGS. 2A and 2B that the cross polarization characteristic and input return loss are improved than those in the conventional waveguide input apparatus of two orthogonally polarized waves.

Figure 3:
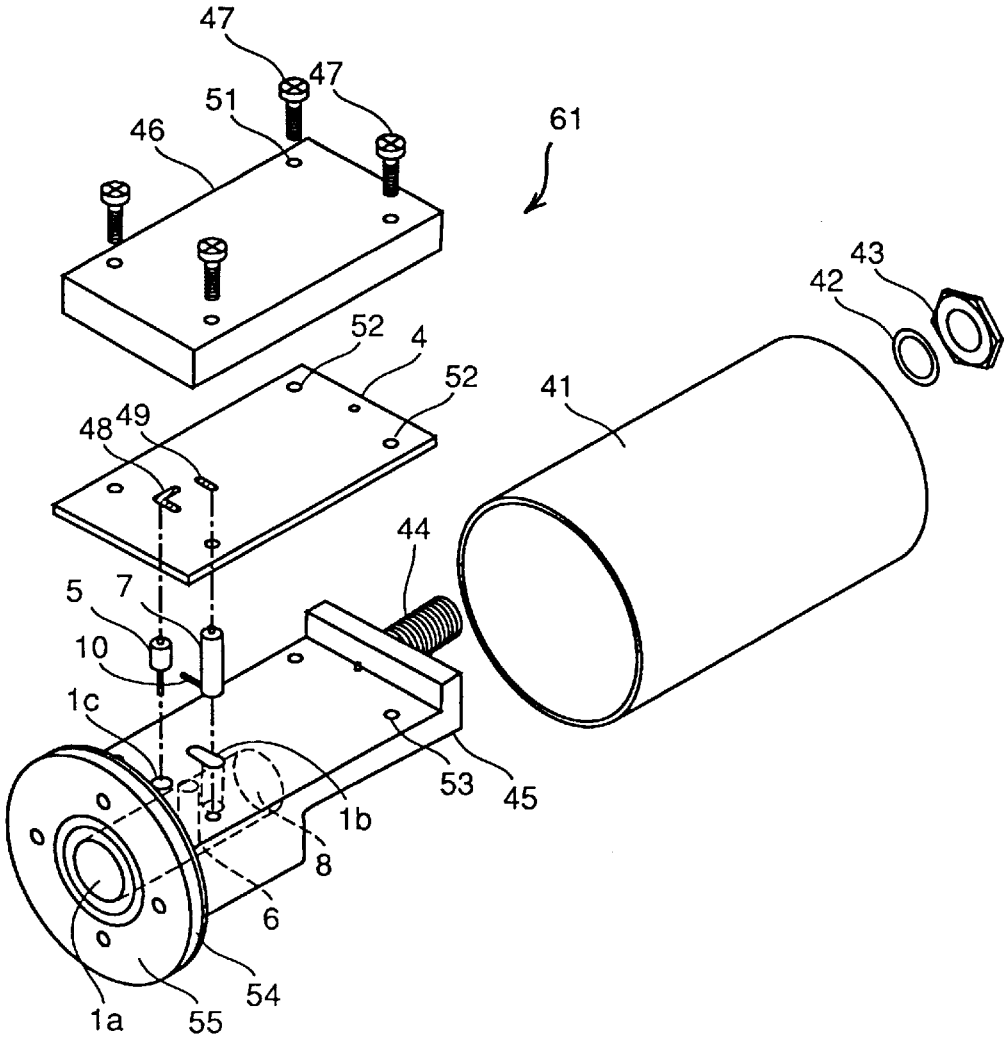
FIG. 3 is an exploded perspective view of the waveguide input apparatus of two orthogonally polarized waves according to the first embodiment of the present invention.

FIG. 3 is an exploded perspective view showing the assembly structure of a converter 61 for satellite broadcasting receiver using the waveguide input apparatus of two orthogonally polarized waves according to the first embodiment. Referring to FIG. 3, probes 5 and 7 are inserted into predetermined holes 1*c* and 1*b*, respectively, of a chassis body 45 including a circular waveguide 1*a*. Here, circuit board 4 is mounted so that the core conductors of probes 5 and 7 pass through respective holes formed in circuit board 4. The core conductors of probes 5 and 7 are connected by soldering and the like to circuit patterns 48 and 49, respectively, formed on circuit board 4. Circuit board 4 and a shield cover 46 are fixed to chassis body 45 by screwing into holes 53 in chassis body 45 respective screws 47 via fixing holes 51 and 52. Circuitry forming the converter is formed on the plane of circuit board 4 facing chassis body 45. This circuitry will be described briefly afterwards.

A cover 55 is attached all over chassis body 45 via a waterproof packing. An output terminal 44 is fixed at the backside of chassis body 45. In inserting chassis body 45 into waterproof cover 41, a fixing nut 43 is fitted to output terminal 44 protruding from the backside via a waterproof packing 42 to secure chassis body 45.

The vertically polarized wave and horizontally polarized wave in circular waveguide 1*a* are reflected at short bar 6 and short wall 8 and received by probes 5 and 7, respectively to be sent to the circuit forming the converter on circuit board 4. The signal amplified on circuit board 4 and converted into a signal of intermediate frequency is sent to output terminal 44 fixed to chassis body 45 to be output.

Figure 4:
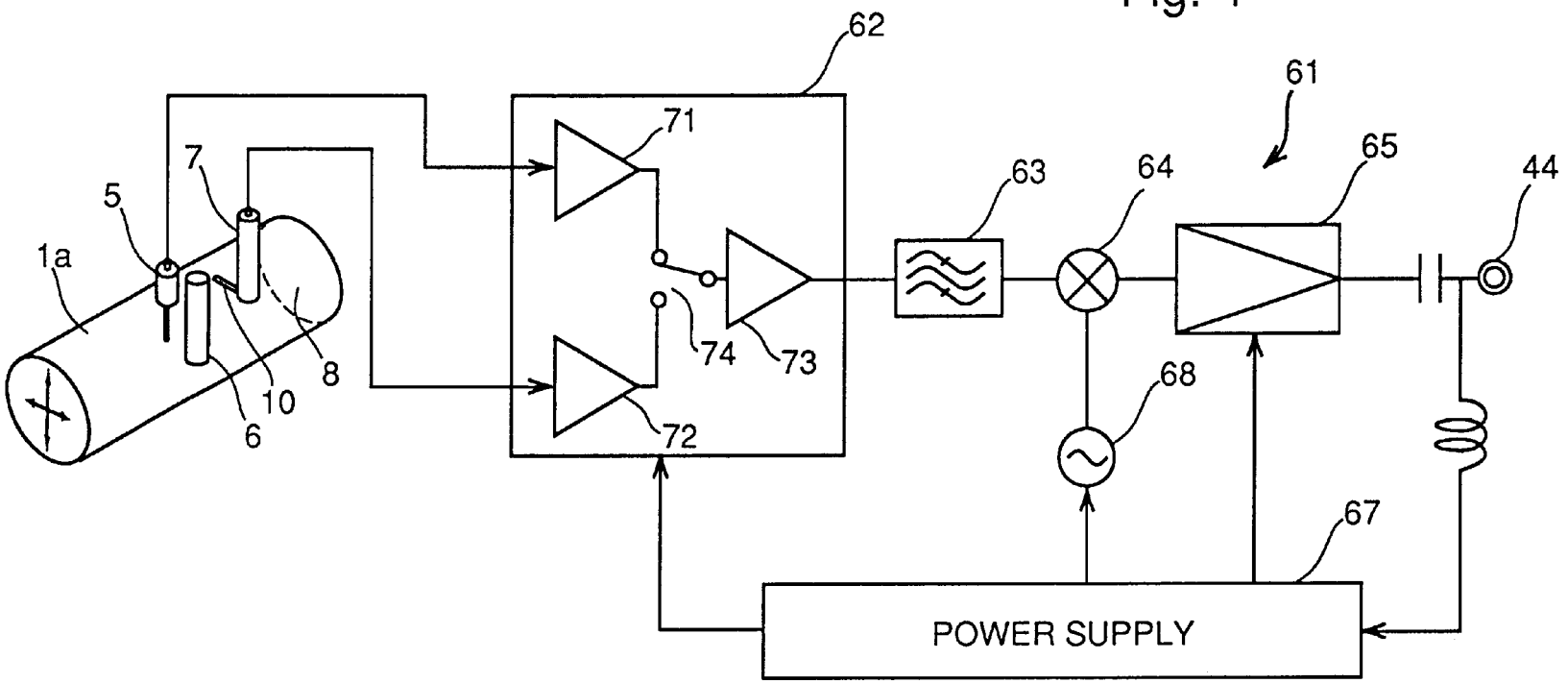
FIG. 4 is a schematic block diagram of a satellite broadcasting converter using the waveguide input apparatus of two orthogonally polarized waves according to the first embodiment of the present invention.

FIG. 4 shows the circuit configuration of a converter for satellite broadcasting receiver formed on circuit board 4. Referring to FIG. 4, this converter 61 includes an LNA (Low Noise Amplifier) 62 for amplifying a signal from probes 5 and 7, a filter 63 receiving the output from LNA 62, a local oscillator 68, a mixer 64 for combining the output signals from filter 63 and local oscillator 68 for conversion into a signal with intermediate frequency, an intermediate frequency amplifier 65 for amplifying an output signal of mixer 64 for output via output terminal 44, and a power supply 67 for supplying power to each circuit.

LNA 62 includes an amplifier 71 for amplifying an output signal of probe 51 an amplifier 72 for amplifying an output signal of probe 7, a switch 74 for switching between the outputs of amplifiers 71 and 72 under control of the operating voltage of the converter, and an amplifier 73 for amplifying the output of switch 74 and providing the amplified output to filter 63.

The polarized wave introduced into waveguide 1*a* is provided to LNA 62 via probes 5 and 7. Either one is selected by switch 74 to be provided to filter 63. The output signal from filter 63 is combined with the output signal from local oscillator 68 by mixer 63 to be converted into a signal with intermediate frequency. This intermediate frequency signal is further amplified by intermediate frequency amplifier 65 to be output via output terminal 44.

By using the waveguide input apparatus of two orthogonally polarized waves according to the first embodiment as the converter for satellite broadcasting receiver, the component cost of the waveguide input apparatus of two orthogonally polarized waves is suppressed to a low level. Since the assembly thereof is easy, the fabrication cost of the converter itself can be reduced. The usage of the waveguide input apparatus of two orthogonally polarized waves of the first embodiment provides the advantage that it is suitable for mass production. Also, the receiver characteristic is made favorable.

The converter shown in FIGS. 3 and 4 is applicable, not only to the waveguide input apparatus of two orthogonally polarized wave of the first embodiment, but also to the waveguide input apparatus of two orthogonally polarized waves according to the second to twelfth embodiments of the present invention. The advantage described in respective embodiments can be achieved in addition to, or as an alternative to, the advantage described in the first embodiment.

A waveguide input apparatus of two orthogonally polarized waves according to the second to fifth embodiments of the present invention will be described hereinafter with reference to FIGS. 5–8 which are sectional views corresponding to cross section I—I of FIG. 1C.

Figure 5:
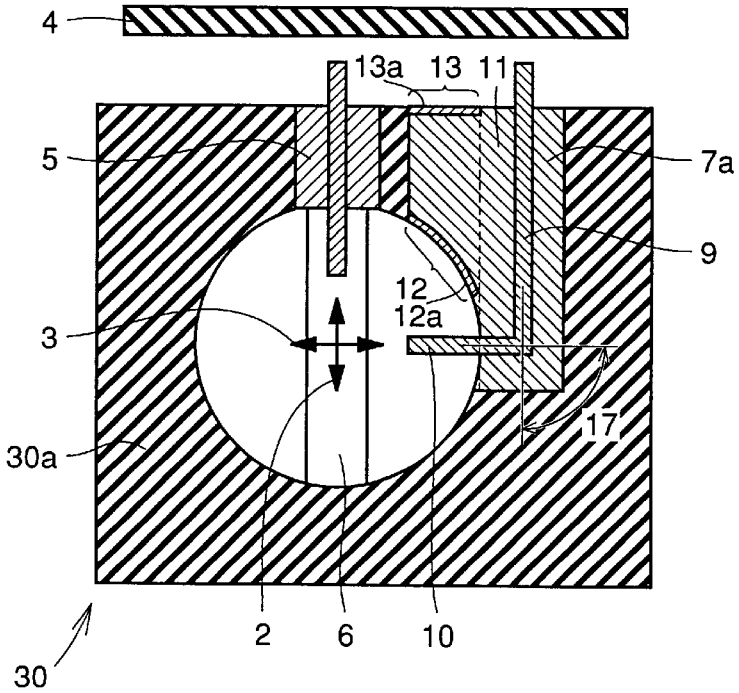
FIGS. 5, 6, 7 and 8 are front sectional views of a waveguide input apparatus of two orthogonally polarized waves according to second, third, fourth and fifth, embodiments, respectively, of the present invention.

As shown in FIG. 5, a waveguide input apparatus 30 of two orthogonally polarized waves according to the second embodiment of the present invention differs from the waveguide input apparatus shown in FIGS. 1A–1C in that a dielectric 11 around core conductor 9 of probe 7*a* forms a portion 12 of the inner wall of waveguide 30*a* that seals the hole, and that partial portions 12 and 13 at the surface of dielectric 11 are covered with thin film metals 12*a* and 13*a*, respectively. By adjusting the dielectric constant of dielectric 11 so as to match the impedance within the waveguide, and adjusting the bending angle 17 of core conductor 9 so as to match the impedance in the waveguide, a higher performance can be maintained.

Figure 6:
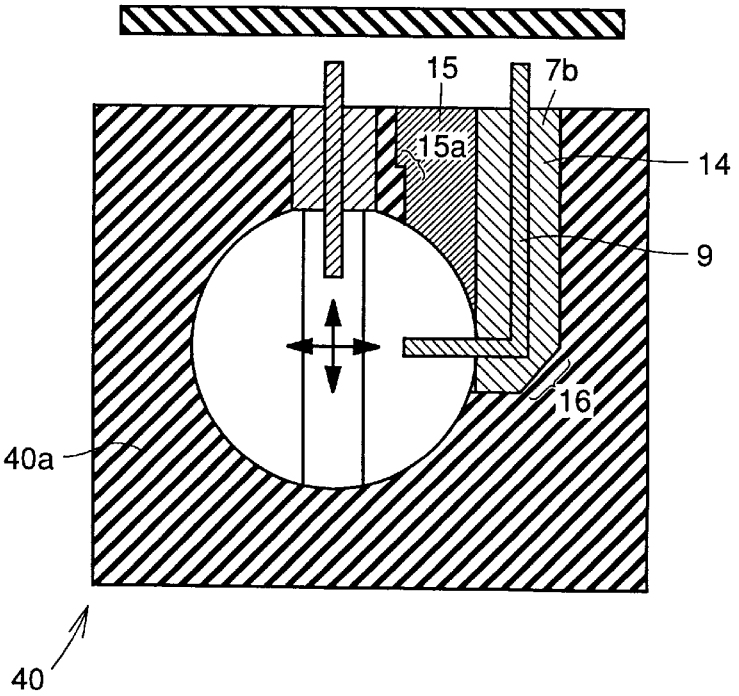

A waveguide input apparatus of two orthogonally polarized waves according to a third embodiment of the present invention will be described with reference to FIG. 6. A waveguide input apparatus 40 of two orthogonally polarized waves of the third embodiment differs from the waveguide input apparatus of two orthogonally polarized waves shown in FIGS. 1A–1C in that probe 7*b* includes a dielectric 14 around core conductor 9 and a conductor portion 15 forming a portion of the inner wall of the waveguide. Similarly to the case of FIG. 5, probe 7*b* seals the hole in waveguide 40*a*. Conductor portion 15 and dielectric 14 are formed of separate members. Conductor 15 is introduced after insertion of probe 7*b*. A shoulder 15*a* is provided to prevent conductor 15 from falling downwards. A higher performance can be maintained by using dielectric 14 having the dielectric constant and configuration of bending portion 16 adjusted so as to match the impedance in the waveguide, and by using a core conductor having the bent angle adjusted.

Figure 7:
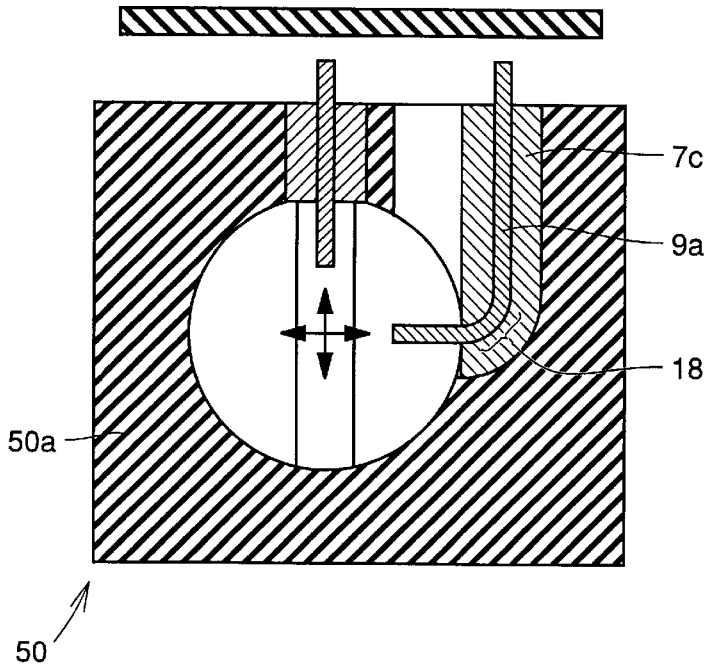

A waveguide input apparatus of two orthogonally polarized waves according to a fourth embodiment of the present invention will be described with reference to FIG. 7. A waveguide input apparatus 50 of two orthogonally polarized waves differs from the waveguide input apparatus shown in FIGS. 1A–1C in that a portion of core conductor 9*a* of probe 7*c* has a configuration of a quadrant 18. In contrast to core conductor 9 having a perpendicularly bent configuration as shown in FIGS. 1A–1C, reflectance and interference of a signal within the core conductor are reduced to achieve favorable impedance. This means that a signal of a broader band of frequency can be received in good shape and the return loss can be reduced. Therefore, the receiver characteristic is improved. Furthermore, the present embodiment provides the advantage that the working process is easier than that for a probe with a perpendicular bent portion. It is suitable for mass production.

Figure 8:
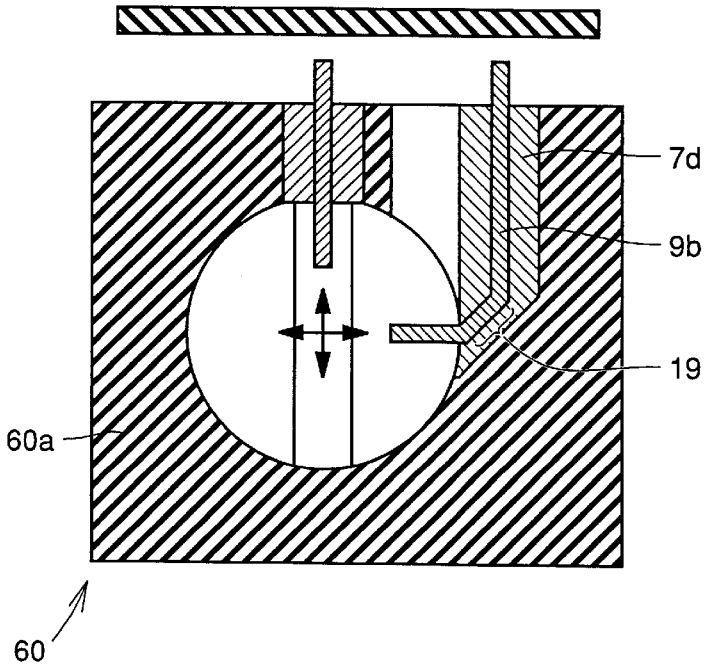

An example of a waveguide input apparatus of two orthogonally polarized waves according to a fifth embodiment of the present invention will be described with reference to FIG. 8. A waveguide input apparatus 60 of two orthogonally polarized waves differs from the waveguide input apparatus of two orthogonally polarized waves shown in FIGS. 1A–1C in that a portion of core conductor 9*b* of probe 7*d* has a configuration 19 bent 45°. Similar to the case of FIG. 7, reflectance and interference of a signal within the core conductor, particularly at the bending portion, can be reduced to achieve favorable impedance. Therefore, a signal of a broader band of frequency can be received in good shape. Therefore, the receiver characteristic is improved. The present embodiment provides the advantage that the working process is more easy than that of a probe with a perpendicular bent portion. The waveguide input apparatus of the present embodiment is also superior in mass production.

According to the above-described second to fifth embodiments, a waveguide input apparatus of two orthogonally polarized waves that can achieve a further favorable receiver characteristic can be provided by appropriately selecting the material, structure, configuration of the probes and the configuration of the core conductor.

Figure 9C:
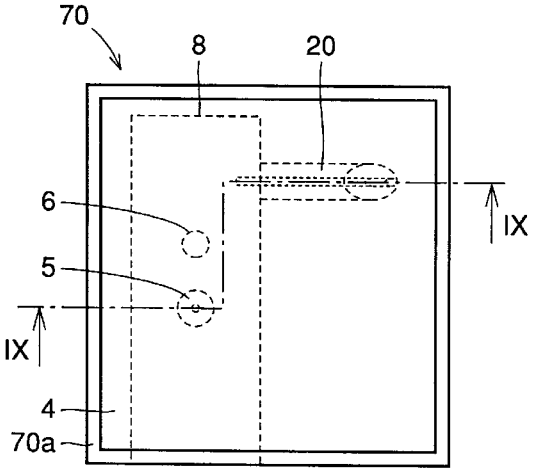
FIG. 9A, 9B, and 9C are a front sectional view, a side view, and a plan view, respectively, of the waveguide input apparatus of two orthogonally polarized waves according to a sixth embodiment of the present invention.
Figure 9A:
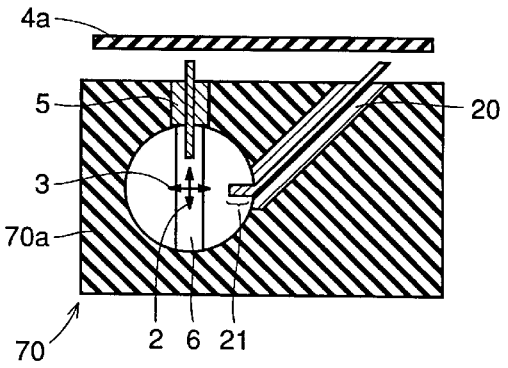
Figure 9B:
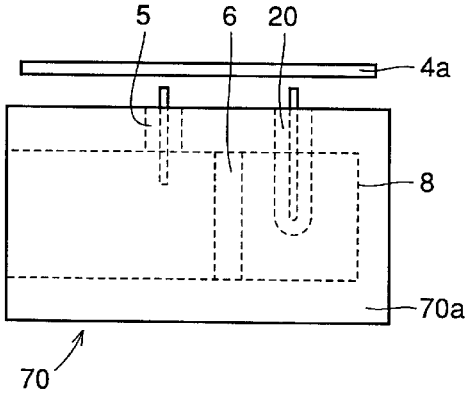

A waveguide input apparatus of two orthogonally polarized waves according to a sixth embodiment of the present invention will be described with reference to FIGS. 9A–9C. FIG. 9A is a sectional view taken along cross section IX—IX of FIG. 9C. Elements corresponding to those of the waveguide input apparatus of two orthogonally polarized waves according to the first embodiment described with reference to FIGS. 1A–1C have the same reference character allotted. Detailed description thereof will not be repeated here.

A waveguide input apparatus 70 of the present sixth embodiment differs from the waveguide input apparatus of FIGS. 1A–1C in that probe 5 is located parallel to plane of polarization 2 (vertically polarized wave) and at an angle of 45° to the other probe 20, and that the configuration of leading end 21 of the core conductor of probe 20 is adjusted so as to match the impedance within waveguide 70*a*. Probe 20 is inserted into the hole in an oblique direction of 45° in waveguide 70*a*. The length of leading end 21 is selected to be insertable into the hole.

According to the sixth embodiment, the two probes 5 and 20 for receiving two orthogonally polarized waves are connected to the same circuit board 4*a*. Probe 5 is attached in a direction orthogonal to the outer wall of waveguide 70*a*.

In contrast to the case where two probes are connected to separate circuit boards, the circuit design including the arrangement of the circuit pattern for the combine process of two polarized waves which are high frequency signals can be simplified. The material cost can be reduced since only one circuit board is required. A waveguide input apparatus of two orthogonally polarized waves superior in cross polarization characteristic and input return loss can be provided.

In contrast to the case where two probes are attached at an angle of 45° with respect to each other at the outer wall of a waveguide, the object of the structure design of the attachment of one probe 5 and the object of the working process of the attachment of probe 5 corresponds to a simple structure using a hole that can be formed with a mold. The attachment workability of probe 5 is improved. Therefore, the assembly working process cost can be reduced. A waveguide input apparatus of two orthogonally polarized waves superior in mass production can be provided.

Figure 10C:
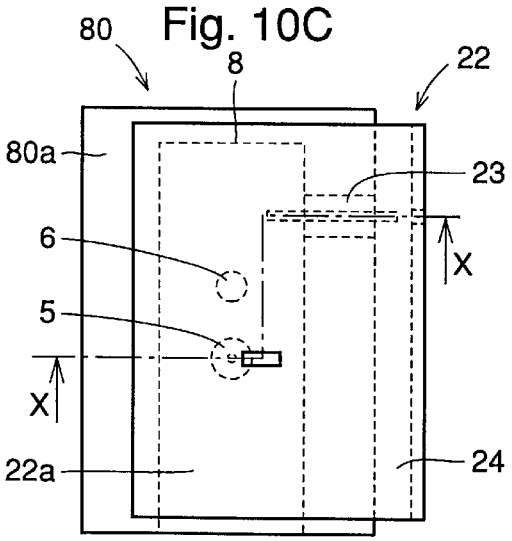
FIGS. 10A, 10B and 10C are a front sectional view, a side view, and a plan view, respectively, of a waveguide input apparatus of two orthogonally polarized waves according to a seventh embodiment of the present invention.
Figure 10A:
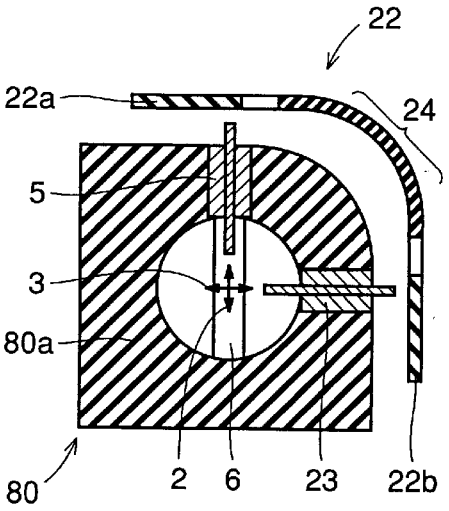
Figure 10B:
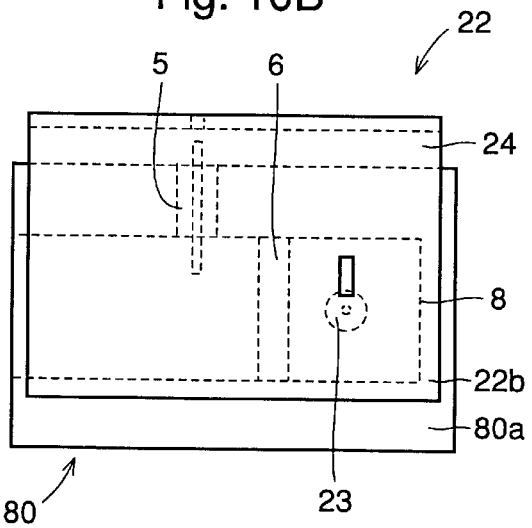

A waveguide input apparatus of two orthogonally polarized waves according to a seventh embodiment of the present invention will be described hereinafter with reference to FIGS. 10A–10C. FIG. 10A is a sectional view taken along the cross section of X—X of FIG. 10C. A waveguide input apparatus 80 of two orthogonally polarized waves differs from the waveguide input apparatus of two orthogonally polarized waves according to the first embodiment described with reference to FIGS. 1A–1C in that a probe 23 is provided in a direction parallel to the plane of polarization 3 of a horizontally polarized wave, and that probes 5 and 23 are connected to a circuit board 22 having a circuit board portion 22*a* and a circuit board portion 22*b* coupled by a flexible board 24. Assembly is implemented by connecting circuit board 22 to probes 5 and 23 after probes 5 and 23 are attached. The present invention is not limited to the illustrated example where circuit board 22 is coupled by flexible board 24. Circuit board 22 may be a circuit board formed integrally in a similar configuration. Preferably, the corner of the waveguide 80*a* corresponding to the portion 24 has a round shape.

According to the seventh embodiment, two probes receiving two orthogonally polarized waves are connected to the same circuit board 22. The two probes 5 and 23 are attached in a direction orthogonal to respective outer walls of the waveguide.

Therefore, in contrast to the case where two probes are connected to separate circuit boards, the circuit design including arrangement of the circuit pattern for the combine process of two polarized waves which are high frequency signals can be simplified. The material cost can be reduced since only one circuit board is required. A waveguide input apparatus of two orthogonally polarized waves superior in cross polarization characteristic and input return loss can be provided.

In contrast to the case where two probes are attached at an angle of 45° with respect to each other at the outer wall of a waveguide, the object of the structure design of the probe attachment and the object of the working process of the probe attachment has a simple structure using a hole that can be formed with a mold. The probe attachment workability is improved. Therefore, the assembly process cost can be reduced. A waveguide input apparatus of two orthogonally polarized waves can be provided superior in mass production.

Figure 11A:
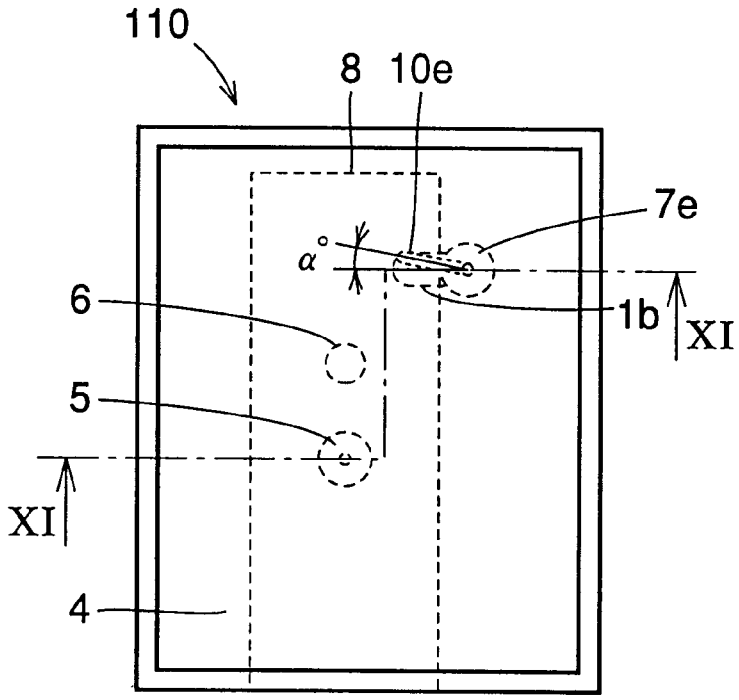
FIGS. 11A and 11B are a plan view and a front sectional view, respectively, of a waveguide input apparatus of two orthogonally polarized waves according to an eighth embodiment of the present invention.
Figure 11B:
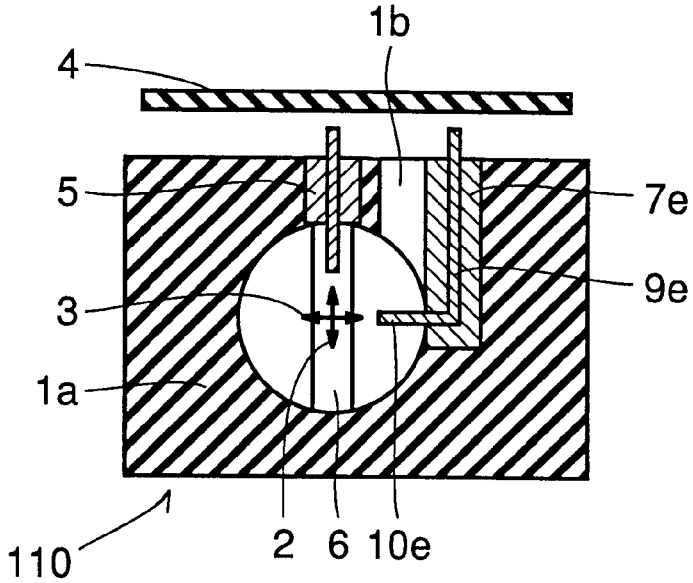

A waveguide input apparatus of two orthogonally polarized waves according to an eighth embodiment of the present invention will be described with reference to FIGS. 11A–11B. FIG. 11B is a sectional view taken along line XI—XI of FIG. 11A. Elements similar to those of the waveguide input apparatus of two orthogonally polarized waves according to the first embodiment of the present invention shown in FIGS. 1A–1C have the same reference characters allotted. Detailed description thereof will not be repeated here.

A waveguide input apparatus 110 of two orthogonally polarized waves of the present eighth embodiment differs from waveguide input apparatus 1 of two orthogonally polarized waves according to the first embodiment shown in FIGS. 1A–1C in that a leading end 10*e* of a probe 7*e* is attached deviated by a predetermined angle $\alpha$ about the core axis of probe 7*e* in a plane including the center axis of the waveguide and leading end 10*e*, and parallel to the plane of polarization of a horizontally polarized wave.

By deviating leading end 10*e* by a certain angle, the distance between leading end 10*e* and each component, particularly the leading end of probe 5, short bar 6, and short wall 8 is altered to improve the characteristic depending upon the angle. The angle of obtaining favorable characteristic differs depending upon the dimension of each component and variation thereof, the wavelength of the polarized wave of interest, and the like. It is appreciated that favorable characteristics cannot be obtained with a relatively great angle. This angle $\alpha$ is preferably within approximately ±20°, further preferably within approximately ±10° with respect to the attached angle in the first embodiment as 0°. By attaching probe 7*e* at an angle within this range where favorable characteristic is obtained, error due to variation of the components at the time of fabrication can be eliminated. Therefore, a waveguide input apparatus of two orthogonally polarized waves with favorable characteristic can be obtained.

A waveguide input apparatus of two orthogonally polarized waves according to a ninth embodiment of the present invention will be described with reference to FIGS. 12A and 12B. FIG. 12B is a sectional view taken along line XII—XII of FIG. 12A. Components similar to those of the waveguide input apparatus of two orthogonally polarized waves according to the first embodiment described with reference to FIGS. 1A–1C have the same reference characters allotted. Detailed description thereof will not be repeated here.

A waveguide input apparatus 120 of two orthogonally polarized waves according to a ninth embodiment of the present invention differs from waveguide input apparatus 1 of two orthogonally polarized waves according to the first embodiment shown in FIGS. 1A–1C in that cavity 1*b* shown in FIGS. 1A–1C is absent and a deep groove 120*b* having a size and depth in which the leading edge 10 of probe 7 can be inserted vertically is formed where probe 7 is to be provided. Another difference is that a cut 120*c* is formed at the leading end (the deepest portion) in deep groove 120*b* so that leading end 10 of probe 7 protrudes into waveguide 1*a*. The size of cut 120*c* is selected so that leading end 10 can pass therethrough.

By inserting probe 7 deep into deep groove 120*b* vertically and then sliding probe 7 towards the interior of waveguide 1*a*, leading end 10 of probe 7 projects through cut 120*c* to protrude into waveguide 1*a*. The portion of cut 120*c* other than leading end 10 is blocked by the circumference of probe 7. Such a structure provides the advantage that the cavity formed at the inner wall of waveguide 1*a* is reduced in size, and the major portion of the inner wall can be formed integrally with the metal conductor. In contrast to the apparatus of the first embodiment, further favorable receiver characteristic and cross polarization characteristic can be maintained.

A waveguide input apparatus of two orthogonally polarized waves according to a tenth embodiment of the present invention will be described with reference to FIGS. 13. FIG. 13 is a front sectional view corresponding to the cross section taken along line XII—XII of FIG. 12A. Components corresponding to those of the waveguide input apparatus of two orthogonally polarized waves according to the ninth embodiment described with reference to FIGS. 12A–12B have the same reference characters allotted. Therefore, detailed description thereof will not be repeated here.

Figure 12A:
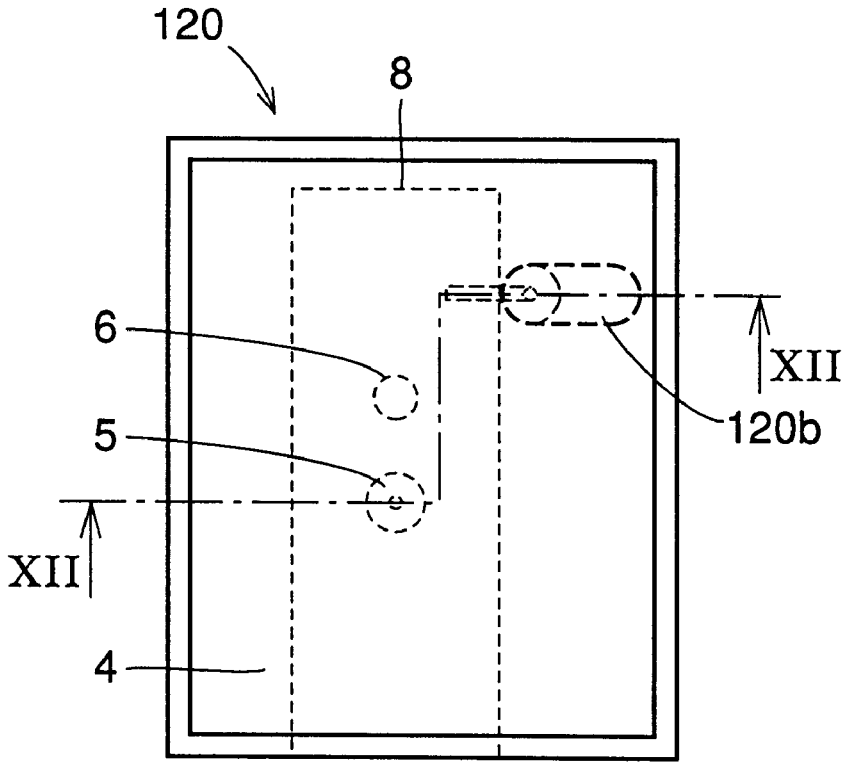
FIGS. 12A and 12B are a plan view and a front sectional view, respectively, of a waveguide input apparatus of two orthogonally polarized waves according to a ninth embodiment of the present invention.
Figure 12B:
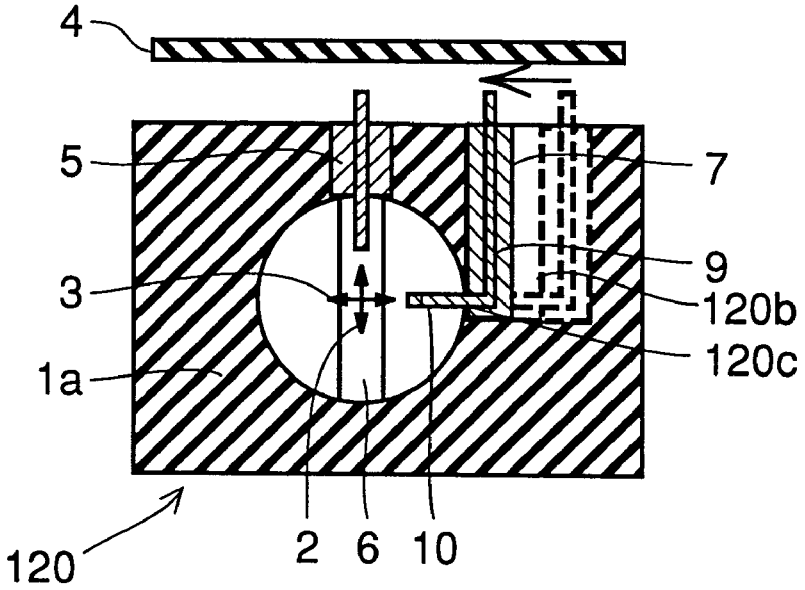
Figure 13:
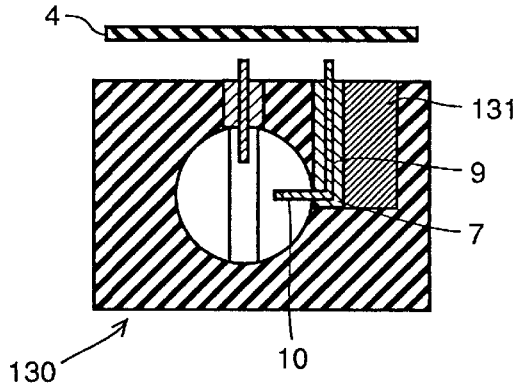
FIG. 13 is a front sectional view of a waveguide input apparatus of two orthogonally polarized waves according to a tenth embodiment of the present invention.

A waveguide input apparatus 130 of two orthogonally polarized waves of the tenth embodiment differs from the waveguide input apparatus 120 of two orthogonally polarized waves according to the ninth embodiment shown in FIGS. 12A–12C in that a metal conductor 130 is inserted by compression into a cavity formed after probe 7 inserted into deep groove 120*b* shown in FIGS. 12A–12C is slid and fixed. By inserting metal conductor 131 into the cavity by compression, the transmission loss can be reduced since the transmission impedance can be improved. Thus, receiver characteristic and cross polarization characteristic more favorable than those in the apparatus of ninth embodiment can be maintained.

Figure 14A:
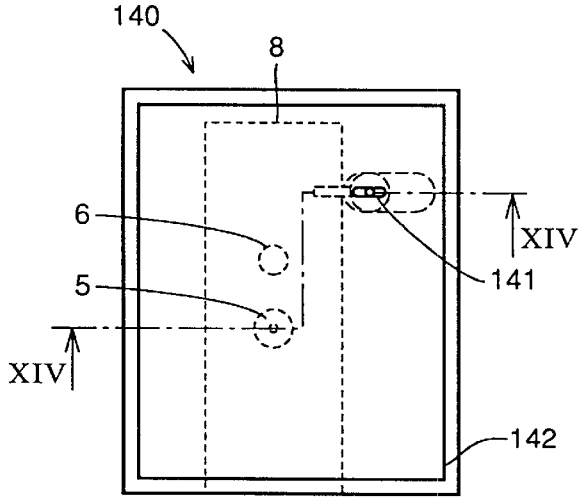
FIGS. 14A and 14B are a plan view and a front sectional view, respectively, of a waveguide input apparatus of two orthogonally polarized waves according to an eleventh embodiment of the present invention.
Figure 14B:
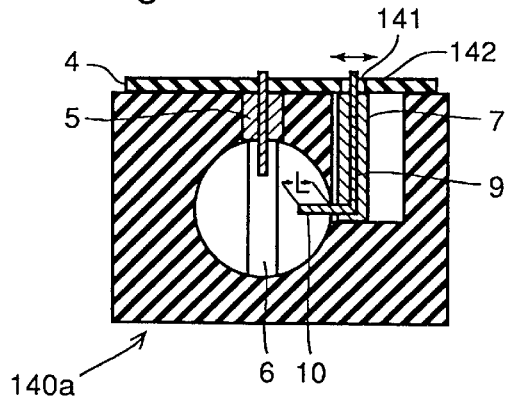

A waveguide input apparatus of two orthogonally polarized waves according to an eleventh embodiment of the present invention will be described with reference to FIGS. 14A–14B. FIG. 14A is a front sectional view of a cross section taken along line XIV—XIV of FIG. 14A. In the present drawings, components corresponding to those of the input apparatus of two orthogonally polarized waves of the ninth embodiment shown in FIGS. 12A and 12B have the same reference characters allotted. Detailed description thereof will not be repeated here.

A waveguide input apparatus 140 of two orthogonally polarized waves according to the eleventh embodiment differs from waveguide input apparatus 120 of two orthogonally polarized waves according to the ninth embodiment of the present invention shown in FIGS. 12A–12B in that connection hole 141 of probe 7 formed at circuit board 142 has a configuration of an ellipse aligned with the major axis in the sliding direction of probe 7. This ellipse configuration allows the length L of the portion of leading end 10 protruding into the waveguide to be adjusted before probe 7 is fixed to circuit board 142 by soldering and the like. By this configuration, the impedance within the waveguide and between probes can be adjusted. Receiver characteristics and cross polarization characteristics more favorable than those of the waveguide input apparatus of two orthogonally polarized waves of the ninth embodiment can be maintained. The configuration of connection hole 141 being an ellipse allows the position of probe 7 to be adjusted after fabrication of the waveguide input apparatus of the two orthogonally polarized waves.

Figure 15A:
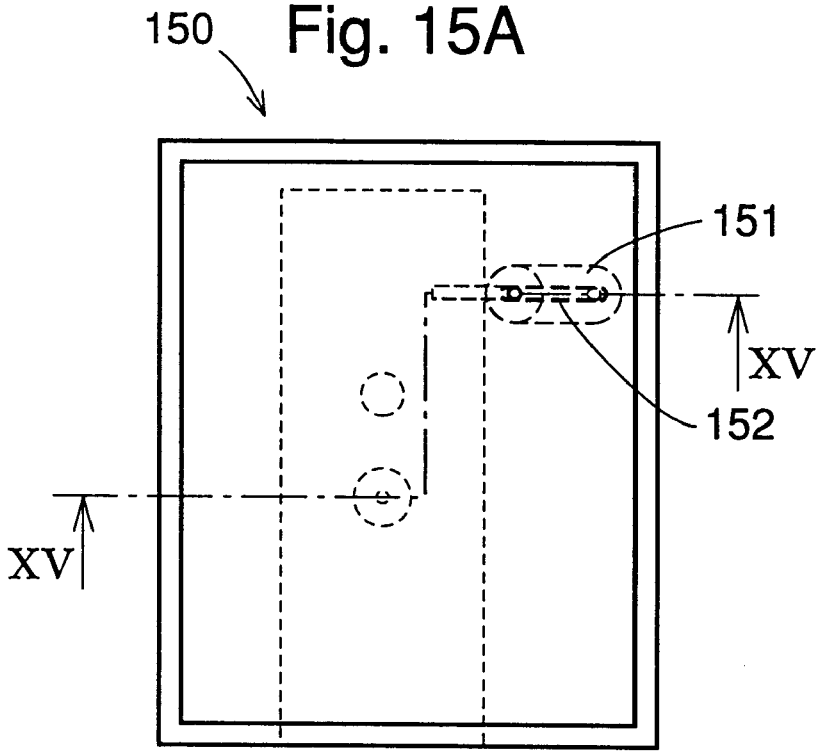
FIGS. 15A and 15B are a plan view and a front sectional view, respectively, of a waveguide input apparatus of two orthogonally polarized waves according to a twelfth embodiment of the present invention.
Figure 15B:
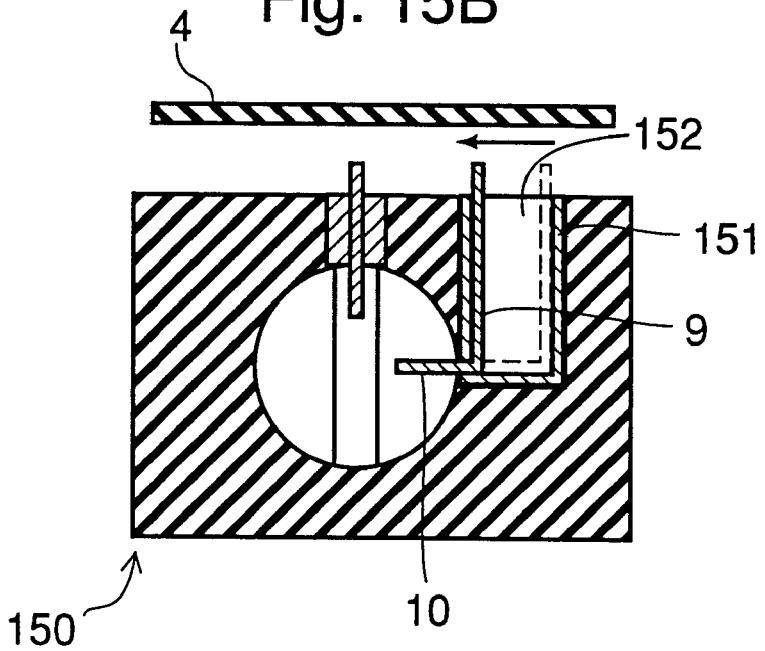
Figure 16C:
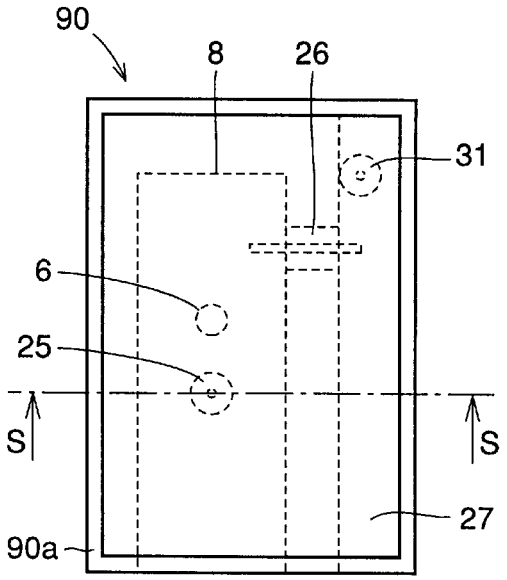
Fig. 16C PRIOR ART
FIGS. 16A, 16B, and 16C are a front sectional view, a side view, and a plan view, respectively, of a conventional waveguide input apparatus of two orthogonally polarized waves.
Figure 16A:
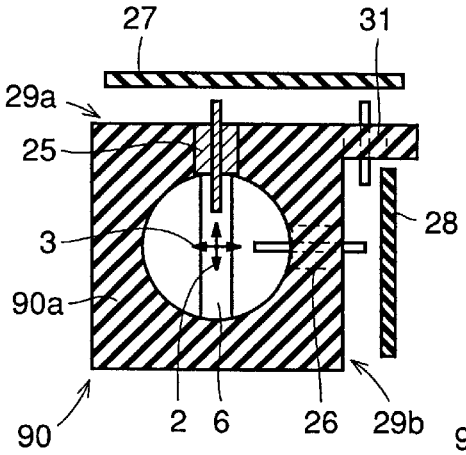
Fig. 16A PRIOR ART
Figure 16B:
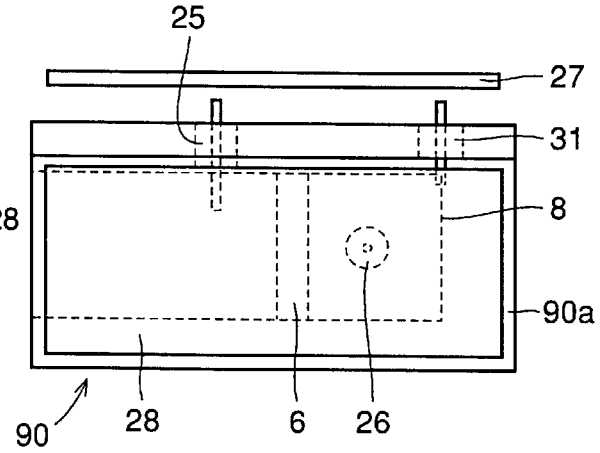
Fig. 16B PRIOR ART
Figure 17C:
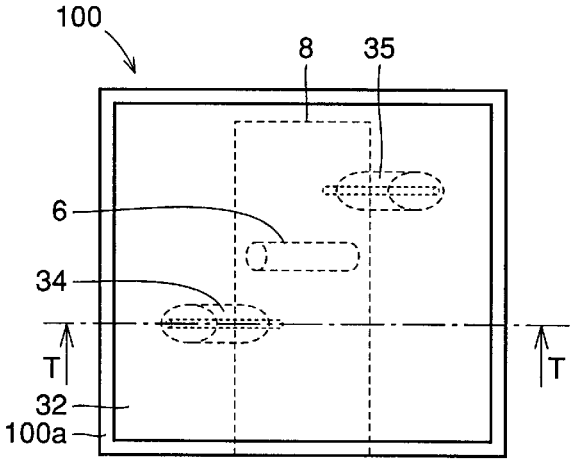
Fig. 17C PRIOR ART
FIGS. 17A, 17B and 17C are a front sectional view, a side view, and a plan view, respectively, of another conventional waveguide input apparatus of two orthogonally polarized waves.
Figure 17A:
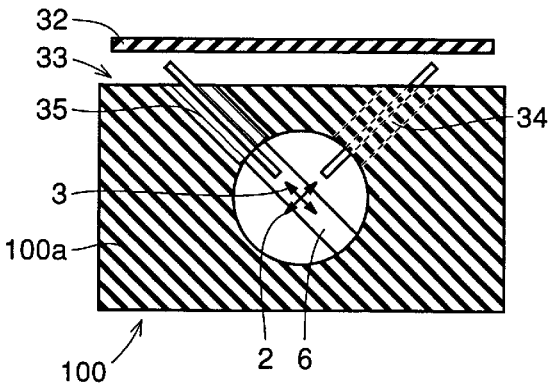
Fig 17A PRIOR ART
Figure 17B:
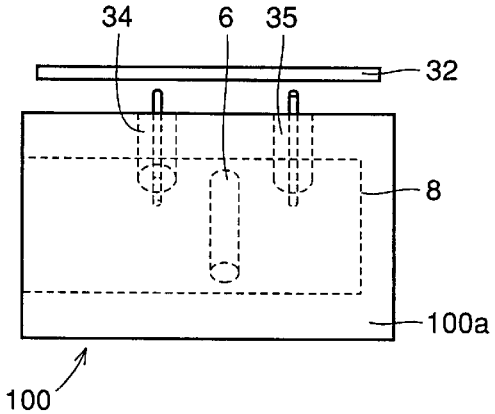
Fig. 17B PRIOR ART

A waveguide input apparatus of two orthogonally polarized waves according to a twelfth embodiment of the present invention will be described with reference to FIGS. 15A and 15B. FIG. 15B is a front sectional view taken along line XV—XV of FIG. 15A. In the drawings, components corresponding to those of the waveguide input apparatus of two orthogonally polarized waves of the ninth embodiment described with reference to FIGS. 12A–12B have the same reference characters allotted. Detailed description thereof will not be repeated here.

A waveguide input apparatus 150 of two orthogonally polarized waves of the twelfth embodiment differs from waveguide input apparatus 120 of two orthogonally polarized waves according to the ninth embodiment shown in FIGS. 12A–12B in that the inner wall of a deep groove similar to deep groove 120*b* shown in FIGS. 12A and 12B is covered with a dielectric 151 to form a thin deep groove 152 having a size and depth in which the bent portion of core axis 9 can be inserted in a vertical direction (in the direction of the depth of the deep groove). Thin deep groove 152 has an opening towards the interior of the waveguide in the proximity of the bottom.

According to the above-described structure, leading end 10 can be made to protrude into the waveguide by sliding core axis 9 after it is inserted into thin deep groove 152. The inner wall of the deep groove portion is covered with dielectric 151. The transmission impedance can be improved with the core conductor and dielectric 151. Receiver characteristic and cross polarization characteristic further preferable than those of the waveguide input apparatus of two orthogonally polarized waves of the ninth embodiment can be maintained.

In the above second to twelfth embodiments of the present invention, a converter for satellite broadcasting receiver using a waveguide input apparatus of two orthogonally polarized waves was not described. However, like the converter for satellite broadcasting receiver described in the first embodiment, a similar converter can be realized without any undue modification by using the waveguide input apparatus of two orthogonally polarized waves described in respective embodiments. It is understood that a similar advantage can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A waveguide input apparatus of two substantially orthogonally polarized waves comprising:

a waveguide into which a first polarized wave and a second polarized wave respectively having a first plane of polarization and a second plane of polarization substantially orthogonal to each other are introduced, and having one end open and another end closed by a short wall, said waveguide having two cavities passing through an outer wall thereof to its interior, a first probe provided protruding from an inner wall of said waveguide via a first said cavity so that a leading end is substantially parallel to said first plane of polarization, a second probe provided protruding from the inner wall of said waveguide via a second said cavity so that a leading end is substantially parallel to said second plane of polarization, and a circuit board provided at said outer wall to be substantially parallel to said second plane of polarization, and directly connected to said first probe and said second probe.

2. The waveguide input apparatus according to claim 1, wherein said second probe comprises a core conductor, said core conductor including a first portion from said circuit board and provided protruding at said inner wall side of said waveguide, and a leading end bent from a leading end of said first portion so as to be substantially parallel to said second plane of polarization, and substantially at a right angle to said first plane of polarization.

3. The waveguide input apparatus according to claim 2, wherein said second probe further comprises a dielectric covering said first portion of said core conductor.

4. The waveguide input apparatus according to claim 3, further comprising a metal thin film covering a surface of said dielectric.

5. The waveguide input apparatus according to claim 3, wherein an end portion of said dielectric at said leading end side of said second probe is formed as a portion of said inner wall of said waveguide.

6. The waveguide input apparatus according to claim 3, wherein said second probe further comprises a conductor attached to said dielectric, and filling a portion remaining in said second cavity when said core conductor and said dielectric are inserted into said second cavity.

7. The waveguide input apparatus according to claim 6, wherein said waveguide includes a shoulder at an inner wall of said second cavity, formed towards the interior at a portion filled with said conductor, wherein said conductor includes a stepped portion abutted against said shoulder at the inner wall of said second cavity.

8. The waveguide input apparatus according to claim 2, wherein said first portion of said second probe is formed to be substantially parallel to said first plane of polarization, and wherein said leading end of said second probe is bent to be substantially at a right angle to said first portion and in a direction substantially at a right angle to said first plane of polarization.

9. The waveguide input apparatus according to claim 1, wherein said second probe is attached to said circuit board so that said leading end of said second probe is deviated within a predetermined angle range ($\pm\alpha$) about a direction substantially orthogonal to a center axis of said waveguide in a plane substantially parallel to said second plane of polarization.

10. The waveguide input apparatus according to claim 1, wherein said second cavity is a deep groove having an opening at a plane of said waveguide facing said circuit board, and an opening at said inner wall of said waveguide where a leading end at the bottom of said deep groove is located, said deep groove having a configuration in which said leading end of said second probe can be inserted while being substantially parallel to said second plane of polarization, wherein said second probe is slid after being inserted into said deep groove so that said leading end of said second probe passes through the opening at the leading end of said bottom of said deep groove to protrude towards an inner cavity of said waveguide.

11. The waveguide input apparatus according to claim 10, further comprising a metal conductor filling a space remaining in said deep groove after said second probe is slid.

12. The waveguide input apparatus according to claim 10, wherein said second probe is slidable in said deep groove in a direction crossing the center axis of said waveguide in a plane substantially parallel to said second plane of polarization, wherein said circuit board has a connection hole of an ellipse configuration with the major axis in a sliding direction of said second probe, and into which a base portion of said first portion of said second probe is inserted.

13. The waveguide input apparatus according to claim 10, further comprising a dielectric layer covering an inner wall of said deep groove.

14. The waveguide input apparatus according to claim 13, wherein said dielectric layer has a thin deep groove formed in said deep groove, having a size and depth in which the core axis of said second probe can be inserted in said deep groove while said leading end of said second probe is maintained substantially parallel to said second plane of polarization, wherein said core axis is slid after being inserted in said thin deep groove so that said leading end of said second probe protrudes into said waveguide.

15. The waveguide input apparatus according to claim 1, wherein said first probe and said second probe are substantially parallel to each other in a direction substantially orthogonal to the outer wall.

16. The waveguide input apparatus according to claim 1, wherein one of said first probe and said second probe is comprised of at least one of a polyethylene resin and a fluoropolymer resin.

17. A converter for satellite broadcasting receiver comprising:

a waveguide input apparatus of two substantially orthogonally polarized waves, and a satellite broadcasting receiver converter circuit receiving an output of said waveguide input apparatus of two substantially orthogonally polarized waves, wherein said waveguide input apparatus comprises a waveguide into which a first polarized wave and a second polarized wave having a first plane of polarization and a second plane of polarization, respectively, substantially orthogonal to each other are introduced, and having one end open, and another end closed by a short wall, said waveguide having two cavities passing through an outer wall thereof to its interior, a first probe provided protruding from an inner wall of said waveguide via a first said cavity so that a leading end is substantially parallel to said first plane of polarization, a second probe provided protruding from an inner wall of said waveguide via a second said cavity, so that a leading end is substantially parallel to said second plane of polarization, and a circuit board provided at said outer wall so as to be substantially parallel to said second plane of polarization, and directly connected to said first probe and said second probe.

18. The converter for satellite broadcasting receiver according to claim 17, wherein said second probe comprises a core conductor, said core conductor including a first portion from said circuit board and provided protruding at said inner wall of said waveguide, and a leading end bent from a leading end of said first portion so as to be substantially parallel to said second plane of polarization and substantially at a right angle to said first plane of polarization.

19. The converter for satellite broadcasting receiver according to claim 18, wherein said first portion of said second probe is formed to be substantially parallel to said first plane of polarization, wherein said leading end of said second probe is bent to be substantially at a right angle to said first portion and in a direction substantially at a right angle to said first plane of polarization.

20. The converter for satellite broadcasting receiver according to claim 18, wherein said second probe further comprises a dielectric covering said first portion of said core conductor.

21. The converter for satellite broadcasting receiver according to claim 20, wherein an end portion of said dielectric at said leading end side of said second probe is formed as a portion of said inner wall of said waveguide.

22. The converter for satellite broadcasting receiver according to claim 20, wherein said waveguide input apparatus of two substantially orthogonally polarized waves further comprises a metal thin film covering a surface of said dielectric.

23. The converter for satellite broadcasting receiver according to claim 20, wherein said second probe further comprises a conductor attached to said dielectric, and filling a portion remaining in said second cavity when said core conductor and said dielectric are inserted into said second cavity.

24. The converter for satellite broadcasting receiver according to claim 23, wherein said waveguide includes a shoulder at an inner wall of said second cavity, formed towards the interior at the portion filled with said conductor, wherein said conductor includes a stepped portion abutted against said stepped portion at the inner wall of said second cavity.

25. The converter for satellite broadcasting receiver according to claim 17, wherein said second probe is attached to said circuit board so that said leading end of said second probe is capable of being deviated within a predetermined angle range ($\pm\alpha$) about a direction substantially orthogonal to the center axis of said waveguide in a plane substantially parallel to said second plane of polarization.

26. The converter for satellite broadcasting receiver according to claim 17, wherein said second cavity is a deep groove having an opening at a plane of said waveguide facing said circuit board, and an opening at an inner wall of said waveguide where a leading end at a bottom of said deep groove is located, said deep groove having a configuration in which said leading end of said second probe can be inserted while being parallel to said second plane of polarization, wherein said second probe is slid after being inserted into said deep groove so that said leading end of said second probe passes through the opening at the end of said bottom of said deep groove to protrude into the inner cavity of said waveguide.

27. The converter for satellite broadcasting receiver according to claim 26, further comprising a metal conductor filling a space remaining in said deep groove after said second probe is slid.

28. The converter for satellite broadcasting receiver according to claim 26, wherein said second probe is slidable in a direction crossing the center axis of said waveguide in a plane substantially parallel to said second plane of polarization within said deep groove, wherein said circuit board has a connection hole of an ellipses configuration with the major axis in a sliding direction of said second probe, and into which a base portion of said first portion of said second probe is inserted.

29. The converter for satellite broadcasting receiver according to claim 26, further comprising a dielectric layer covering an inner wall of said deep groove.

30. The converter for satellite broadcasting receiver according to claim 29, wherein said dielectric layer has a thin deep groove formed in said deep groove, having a size and depth into which the core axis of said second probe can be inserted in said deep groove while said leading end of said second probe is maintained substantially parallel to said second plane of polarization, wherein said core axis is slid after being inserted into said thin deep groove so that said leading end of said second probe protrudes into said waveguide.

31. The converter for satellite broadcasting receiver according to claim 17, wherein said first probe and said second probe are substantially parallel to each other in a direction substantially orthogonal to the outer wall.

32. The converter for satellite broadcasting receiver according to claim 17, wherein one of said first probe and said second probe is comprised of at least one of a polyethylene resin and a fluoropolymer resin.

33. A converter for satellite broadcasting receiver comprising:

a waveguide input apparatus of two orthogonally polarized waves, and a converter circuit for the satellite broadcasting receiver, receiving an output of said waveguide input apparatus of two substantially polarized waves, wherein said waveguide input apparatus of two substantially orthogonally polarized waves comprises a waveguide into which a first polarized wave and a second polarized wave having a first plane of polarization and a second plane of polarization, respectively, substantially orthogonal to each other are introduced, and having one end open and another end closed by a short wall, said waveguide including a first cavity passing through a first outer wall thereof to the interior, and a second cavity passing through a second outer wall thereof to the interior, a first probe provided protruding from an inner wall of said waveguide via said first cavity so that a leading end is substantially parallel to said first plane of polarization, a second probe provided protruding from an inner wall of said waveguide via said second cavity so that a leading end is substantially parallel to said second plane of polarization, and a circuit board portion including a first portion to which said first probe is connected, a second portion to which said second probe is connected, and a flexible portion coupling said first portion and said second portion.

34. The converter for satellite broadcasting receiver according to claim 33, wherein a corner portion at the outer wall of said waveguide in contact with said flexible portion of said circuit board portion is molded to have a rounded form.

35. A waveguide input apparatus of two substantially orthogonally polarized waves comprising:

a waveguide into which a first polarized wave and a second polarized wave respectively having a first plane of polarization and a second plane of polarization orthogonal to each other are introduced, and having one end open and another end closed by a short wall, said waveguide including a first cavity passing through a first outer wall thereof to the interior, and a second cavity passing through a second outer wall to the interior, a first probe provided protruding from an inner wall of said waveguide via said first cavity so that a leading end is parallel to said first plane of polarization, a second probe provided protruding from an inner wall of said waveguide via said second cavity so that a leading end is parallel to said second plane of polarization, and a circuit board including a first portion to which said first probe is connected, a second portion to which said second probe is connected, and a flexible portion coupling said first portion and said second portion.

36. The waveguide input apparatus according to claim 35, wherein a corner portion of the outer wall of said waveguide in contact with said flexible portion of said circuit board portion is molded to have a rounded form.

* * * * *